US009617742B2

(12) United States Patent
Kudrna

(10) Patent No.: US 9,617,742 B2
(45) Date of Patent: Apr. 11, 2017

(54) TILE SPACING DEVICE AND METHOD OF USE

(71) Applicant: John R. Kudrna, Jefferson Hills, PA (US)

(72) Inventor: John R. Kudrna, Jefferson Hills, PA (US)

( * ) Notice: Subject to any disclaimer, the term of this patent is extended or adjusted under 35 U.S.C. 154(b) by 141 days.

(21) Appl. No.: 14/710,811

(22) Filed: May 13, 2015

(65) Prior Publication Data

US 2016/0333596 A1 Nov. 17, 2016

(51) Int. Cl.
*E04F 21/20* (2006.01)
*E04F 21/00* (2006.01)

(52) U.S. Cl.
CPC ..... *E04F 21/0076* (2013.01)

(58) Field of Classification Search
CPC ..... E04F 21/0076
USPC ..... 33/526, 527, 613, 645
See application file for complete search history.

(56) References Cited

U.S. PATENT DOCUMENTS 4,953,341 A * 9/1990 Joos ..... E01C 5/006 33/404
5,293,694 A * 3/1994 Swindle ..... E04F 21/0092 33/481
5,359,783 A * 11/1994 Smith ..... E04F 21/0092 33/526
5,768,793 A * 6/1998 Fields ..... G01B 5/02 33/526
7,617,612 B2 * 11/2009 Brizendine ..... E04D 15/00 33/613
7,946,093 B1 * 5/2011 Sturino ..... E04F 21/0092 33/527
8,919,076 B1 * 12/2014 Kitchens ..... E04F 21/0092 33/527
2002/0121027 A1 * 9/2002 Kruskamp ..... E04F 21/0092 33/526
2004/0060184 A1 * 4/2004 Shilo ..... E04F 21/0092 33/526
2004/0250435 A1 * 12/2004 Fiore ..... E04F 21/0092 33/527
2009/0126213 A1 * 5/2009 Tavy ..... E04F 21/0092 33/527
2010/0050453 A1 * 3/2010 Bryce ..... E04F 21/0076 33/527
2016/0032598 A1 * 2/2016 Anderson ..... E04F 21/0092 206/231
2016/0090746 A1 * 3/2016 Sighinolfi ..... E04F 21/18 33/526
2016/0186449 A1 * 6/2016 Lee ..... E04F 21/0092 33/527

* cited by examiner

*Primary Examiner* — G. Bradley Bennett
(74) *Attorney, Agent, or Firm* — Gary P. Topolosky

(57) ABSTRACT

A tile spacing device comprises a U-shaped handle, a pair of washers affixed to both open ends of the handle; and a gap-creating spacer bar extending between the open handle ends beneath the pair of washers. A method of using this device for improving spacing consistency between horizontally-installed tiles is also disclosed.

19 Claims, 3 Drawing Sheets

TILE SPACING DEVICE AND METHOD OF USE

BACKGROUND OF THE INVENTION

1. Field of the Invention

This invention relates to a device for setting decorative tiles with uniform grout lines and joints. More particularly, it relates to a tile spacer for efficiently setting a plurality of large decorative floor tiles a uniform, consistent width from adjacent tiles.

2. Description of the Related Art

Anyone who has ever installed tile products understands the aggravation with adjusting tiles, especially floor tiles, during installation, to maintain uniform grout lines and joints. The spacing between each piece allows for the eventual placement of grout there between. Known plastic spacers can be set to aid in this process, but they must be moved individually when the next piece is to be installed. This causes an installer to juggle tiles and spacers leading to frustration, lost spacers, broken tile and irretrievable time. While these problems are difficult for the professional tile setter, they pose almost insurmountable problems for the do-it-yourself homeowner.

There remains a long felt need for a simple, lightweight device that takes little storage space when not in use, is highly reusable, easy to manipulate and otherwise overcomes known problems for establishing consistent spacing when setting floor tiles. The development of the present apparatus fulfills this need to assist in the placement of decorative tiles while maintaining uniform grout lines between.

The following references are deemed noteworthy: Claxton U.S. Pat. No. 6,796,049 showed an adjustable tile apparatus with X, T or L-shaped bottom spacers. A ceramic tile spacing gauge and tile holder is the subject of Smith U.S. Pat. No. 5,359,783, Armstrong U.S. Pat. No. 5,038,490 and Fortin U.S. Pat. No. 4,860,723. Bovino et al. U.S. Pat. No. 4,899,455 discloses a tile-squaring device having a distance rod, angle head and squaring means for connecting the angle head to the distance rod at a right angle to the rod. Kingston et al. U.S. Pat. No. 4,712,309 describes an adjustable template for positioning tiles of various sizes and Schell U.S. Pat. No. 2,642,674 discloses an implement for laying square tile using a generally rectangular plate with a pair of spaced apart straight edges.

Consequently, a need exists for providing a device that assists with setting floor tiles (from about 4 to 24 inches wide) with ease and consistency for subsequent grouting there between. The device/apparatus should be made available in a variety of "sizes" or gap thicknesses. Alternately, one handle for this device/apparatus can be fitted with multiple size/shape gap spacers through easy connects/disconnects.

SUMMARY OF THE INVENTION

It is an object of the present invention to provide a tile spacing device that aids in setting decorative floor or wall tile and provides for fast, perfect spacing between tiles.

It is another object of the present invention to provide a device for keeping grout lines consistent and establishes a consistent tile pattern.

It is still another object of the present invention to provide a device for use with most types of small to large floor tile material.

It is another object of the present invention to provide a device that can be adjusted in width dimensions to suit various tile gap sizes.

It is another object of the present invention to provide mounted spacers for use above a tile surface for providing actual grout line spacing.

It is another object of the present invention to provide spacers available in ¼ inch, to 1 inch varieties, and to have an easy means for switching between desired sizes.

Briefly, the present invention shows an adjustable spacing device for setting tiles in a consistent distance apart from one another for achieving grout joints of uniform width. The invention comprises a U-shaped main frame handle, a pair of washers extending downwardly therefrom and a bottom spacer rod/bar fastened thereto. This adjustment allows the invention to work with most sizes of tile work. The spacer bars would be available in ¼ inch, and in ⅛ inch increments above that, up to one inch wide total. That variety of tools will accommodate various sized grout line widths. A pair of such devices is simply moved along as each tile is set and provides perfect spacing for the next tile to be set. The invention can be used with ceramic tile, clay tile, marble, slate, or virtually any material that is set with spacing for grout lines.

DESCRIPTION OF THE DRAWINGS/PHOTOGRAPHS

The advantages and features of the present invention will become better understood with reference to the following detailed description made with reference to the accompanying drawings and photographs in which.

DESCRIPTION OF PREFERRED EMBODIMENTS

The main purpose behind this device, nicknamed the "Kelly Gauge", is to provide consumers (either professional tile installers or do-it-yourselfers) with a tool that facilitates the process for maintaining accurate spacing between adjacent tiles during their initial installation (i.e., as they are first positioned on the setting mortar). This is a known time-consuming task made longer when expending a great deal of effort calculating tile spacing AND placement to avoid uneven relative positioning.

This device replaces the use of small plastic spacer crosses and the like. Workers using those means are often forced to recheck their gapping measurements as smaller spacers are prone to shifting.

Figure 1:
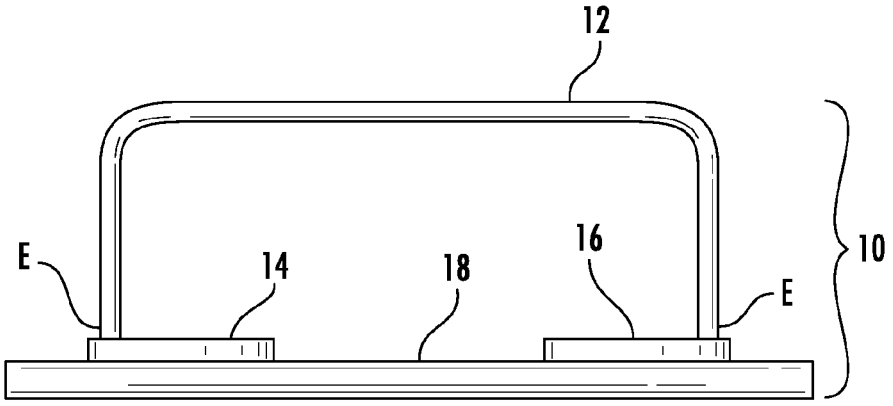
FIG. 1 is a front plan view of one embodiment of adjustable tile spacing apparatus according to the present invention.
Figure 2:
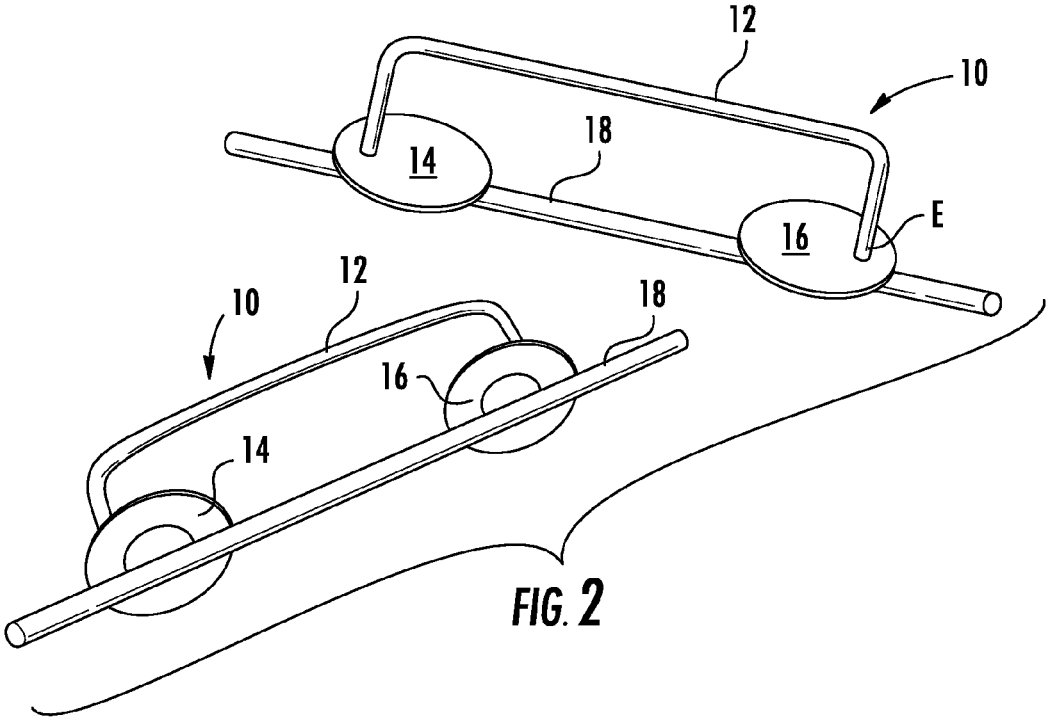
FIG. 2 is a photograph showing a pair of FIG. 1 spacers tilted onto their sides.

The present device, by contrast, is an ingenious, practical and useful (yet simple) tool for gauging grout spacing between tiles quickly and easily. As seen in accompanying FIGS. 1 and 2, one embodiment of tile spacer device 10 that includes a main frame, in this case consisting of a 6¾" in. by 2" U-shaped rod/clamp or handle 12. At the opposed "open" ends to that handle 12, there are incorporated a pair of wide washers 14, 16 located at or near the distal point/ends E of handle 12. These washers provide the tool user/consumer with a FIXED distance for measuring tile grout lines. Washers 14, 16 may be welded to the handle 12 or otherwise affixed. In alternate embodiments (not shown), washers and handle may be constructed as a one piece, intergral unit.

Extending down from below handle 12 and beneath washers 14, 16, there is a gap making, spacer bar 18. Straight in length, bar 18 extends beyond the handle and washers the whole distance between handle ends. In an alternate variation (not shown), that single spacer bar COULD BE replaced with two shorter bars so long as the line between bar sections is maintained a set linear path (i.e., on exactly the same linear plane.

Figure 3:
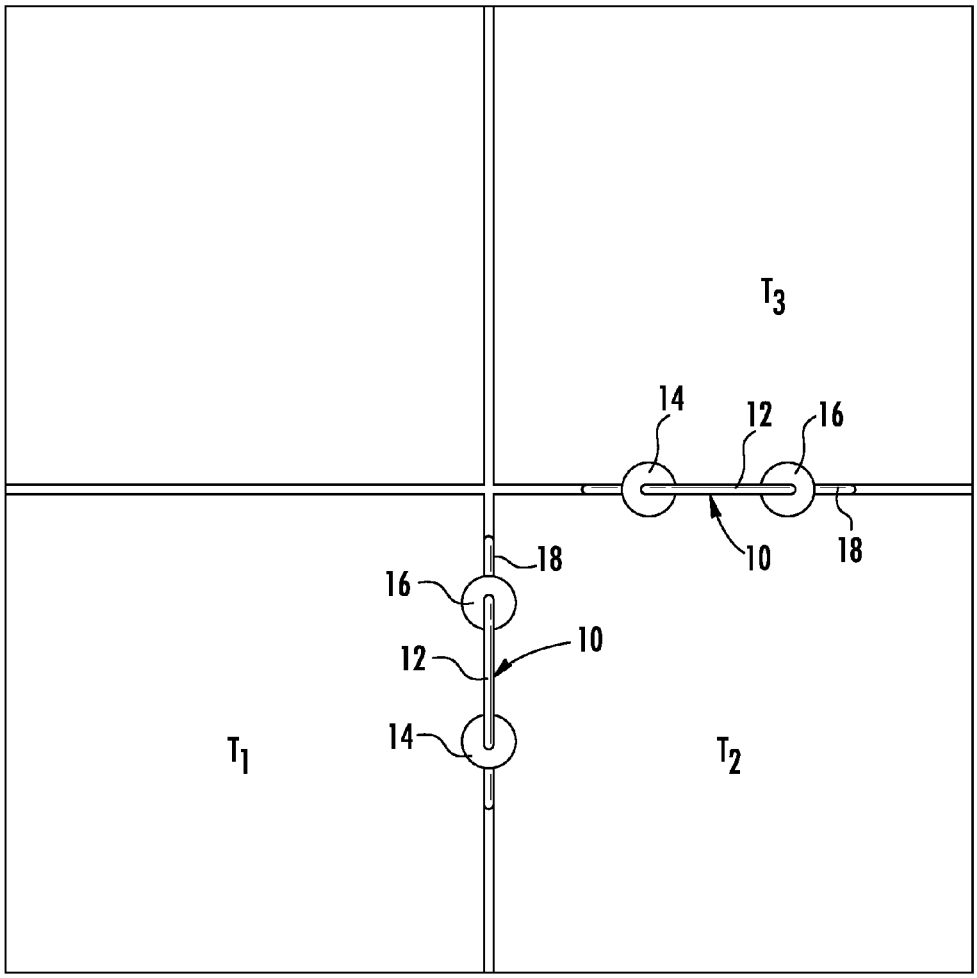
FIG. 3 is a photograph showing the pair from FIG. 2 as used to space adjacent floor tiles according to this invention.

Easy to use, tile spacer 10 is simply inserted between adjacent tiles $T_1$, $T_2$ and $T_3$ on a mortar surface and the next tile placed and adjusted to abut each spacer bar 18 as better seen in accompanying FIG. 3. Using this tool, both the professional tile installer and home do-it-yourselfers can achieve and ensure a uniformed tile gap/appearance.

This invention is an essential tool (that takes up very little space when not in use) for construction workers and for the everyday handyman. It is expected that a uniformly sized spacer device would be sold in pairs for use consistent with the installation depicted in FIG. 3. Consumers may prefer buying only one pair of spacers, or Kelly gauges, in a first grout making size (between ¼" to 1" wide, in ⅛ in. increments). A full set might include one pair in each size.

Figure 4:
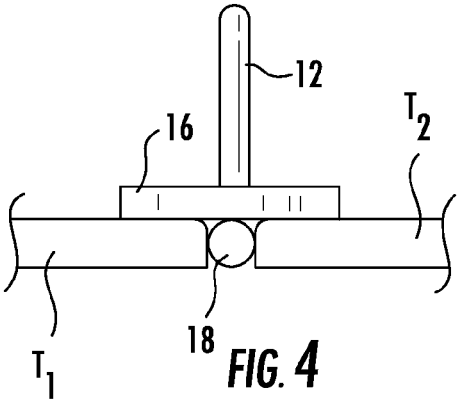
FIG. 4 is a side sectional view showing use of the FIG. 1 spaced between floor tiles T1 and T2.
Figure 5:
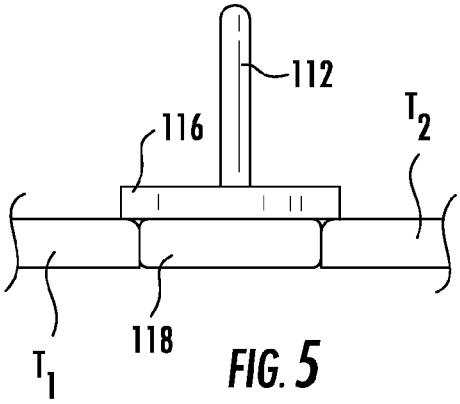
FIG. 5 is a side sectional view of a first alternative spacer that uses a flat-bar shape with rounded edges for making wider tile gaps.

For the most common size device, spacer bar 18 is rounded in cross section, between adjacent tiles $T_1$ and $T_2$ as best seen axially in accompanying FIG. 4. For the wider variations, an alternate spacer bar may appear flatter, than their smaller, thinner, round counterpart. In the alternative device depicted in accompanying FIG. 5, common elements are commonly numbered though in the next hundred series. Accordingly, device 110, with its handle 112 has a spacer bar 118 that is generally rectangular but with certain edges rounded for better fitting (going in) between adjacent tiles $T_1$ and $T_2$ for: setting their fixed tile gap and for allowing some space for welding to the right side washer 116 directly above in this particular axial view.

It is believed that the Kelly gauge described herein is unique. Preferably made from a durable stainless steel, aluminum and/or carbon steel material, the main frame and spacer bar(s) afford the consumer means for securely, yet accurately measuring grout lines. Alternately, it may be made from a strong, wear resilient plastic/composite.

It is envisioned that the present invention may be used with most any flooring material such as ceramic, marble, clay, and slate which is set with spacing for grout lines. For user comfort, padding and/or rubberized handles may be incorporated therein.

Operation of Preferred Embodiments

For the present invention, a user would choose the desired pair of Kelly gauges from his/her set of device pairs. Then, the user would situate a first tool in a first direction and a second tool perpendicular to the adjoining tile side before placing the next tile to be installed immediately adjacent to (or abutting) the two situated tools. Once that tile is firmly in place, the handles of the respective tools can be lifted out of that tile pair for resituating the next floor tile with the same. Using these device pairs, repeatedly, the user achieves a consistent pattern with perfect spacing relative to one another so as to obtain grout joints of uniform width. An experienced tile setter may utilize multiple sets/pairs of Kelly gauges to increase productivity.

Therefore, the foregoing description is included to illustrate the operation of the preferred embodiment and not meant to limit the scope of the invention. One skilled in the art may incorporate minor modifications that are anticipated by this disclosure.

What is claimed is:

1. A tile spacing device comprising: a U-shaped handle, a pair of washers affixed to both open ends of the handle to form a main frame; and a gap-creating spacer bar extending between the open handle ends beneath the pair of washers.

2. The tile spacing device of claim 1 wherein the spacer bar is a single unit sized to temporarily fit between adjacent floor tiles during their initial setting in mortar.

3. The tile spacing device of claim 1 wherein the spacer bar measures about ¼ to 1 inch across at its widest point.

4. The tile spacing device of claim 1 wherein the spacer bar is substantially round in cross-section.

5. The tile spacing device of claim 1 wherein the spacer bar is substantially rectangular in cross-section.

6. The tile spacing device of claim 5 wherein the rectangular spacer bar has rounded edges.

7. The tile spacing device of claim 6 wherein the rectangular spacer bar has rounded bottom edges.

8. The tile spacing device of claim 1, which is made of a metal selected from the group consisting of: stainless steel, aluminum and carbon steel.

9. The tile spacing device of claim 1, which is integrally formed as a one-piece unit.

10. The tile spacing device of claim 9, which is made of a durable plastic or composite material.

11. The tile spacing device of claim 1, which can be used for spacing horizontally-positioned tiles that are each about 4" to about 24" long.

12. A method for improving gap spacing between horizontally-positioned tiles when installing said tiles on a mortar surface, said method comprising:

(a) providing at least two tile spacing devices, each device comprising: a U-shaped handle, a pair of washers affixed to both open ends of the handle to form a main frame; and a gap-creating spacer bar extending between the open handle ends beneath the pair of washers;

(b) positioning a first tile spacer against an open first edge of a first installed tile and a second tile spacer against an open second edge of the first installed tile;

(c) installing a second tile against the first tile spacer;

(d) moving the first tile spacer from between the first and second installed tile to an open edge of the second installed tile; and (e) installing a third tile against the moved first tile spacer.

13. The method of claim 12, wherein four or more tile spacing devices are provided for placing between multiple adjacent tiles.

14. The method of claim 12 wherein the spacer bar of each tile spacing device measures about ¼ to 1 inch across at its widest point.

15. The method of claim 12 wherein the spacer bar of each tile spacing device is substantially round in cross-section.

16. The method of claim 12 wherein the spacer bar of each tile spacing device is substantially rectangular in cross-section.

17. The method of claim 12 wherein the spacer bar of each tile spacing device is made of a metal selected from the group consisting of: stainless steel, aluminum and carbon steel.

18. The method of claim 12 wherein the spacer bar of each tile spacing device is integrally formed as a one-piece unit.

19. The method of claim 12 wherein the spacer bar of each tile spacing device is made of a durable plastic or composite material.

* * * * *